United States Patent [19]

Ishii et al.

[11] 4,130,918

[45] Dec. 26, 1978

[54] LOCK SLIDER FOR SLIDE FASTENERS

[75] Inventors: Susumu Ishii, Kurobe; Tsunetaka Aoki, Kamiichi, both of Japan

[73] Assignee: Yoshida Kogyo K.K., Tokyo, Japan

[21] Appl. No.: 881,114

[22] Filed: Feb. 24, 1978

[30] Foreign Application Priority Data

Mar. 3, 1977 [JP] Japan ..... 52-25439[U]

[51] Int. Cl.[2] ..... A44B 19/30

[52] U.S. Cl. ..... 24/205.14 A

[58] Field of Search ..... 24/205.14 A

[56] References Cited

U.S. PATENT DOCUMENTS

| | | | |
|---|---|---|---|
| 2,223,279 | 11/1940 | Carlile | 24/205.14 A |
| 2,835,011 | 5/1958 | Malcolm | 24/205.14 A |
| 2,968,079 | 1/1961 | Brown | 24/205.14 A |

*Primary Examiner*—Bernard A. Gelak

*Attorney, Agent, or Firm*—Bucknam and Archer

[57] ABSTRACT

A pull tab pivotally connected to a slider body is formed integral with a locking pawl which projects into the guide channel in the slider body through an aperture formed in its top wing. When the pull tab is turned to a recumbent position on the slider body, the locking pawl presses the fastener elements in the guide channel against the bottom wing of the slider body thereby locking the slider against movement. The point of contact of the locking pawl with the fastener elements is located forwardly of the axis of the pivotal motion of the pull tab when the latter is in the recumbent position. Further, when the pull tab is in the recumbent position, the tip of the locking pawl rests against an abutment on the inside surface of the top wing of the slider body.

5 Claims, 3 Drawing Figures

LOCK SLIDER FOR SLIDE FASTENERS

BACKGROUND OF THE INVENTION

1. Field of the Invention

This invention relates to sliders for slide fasteners, and more particularly to improvements in a slider of the type which can be locked against movement in a desired position on rows of interlocking fastener elements upon manual turning of a pull tab to a recumbent position on the slider body, that is, to a plane substantially parallel to the planes of the paired wings or plate members of the slider body.

2. Description of the Prior Art

A lock slider has been suggested wherein the pull tab is integrally provided with a locking pawl which, when the pull tab is manually pivoted to the recumbent position, engages and presses the fastener elements against the slider body thereby locking the slider against movement in either direction. Being connected in a cantilever fashion to the pull tab, however, the locking pawl makes some elastic deformation in engaging the fastener elements as above. The pressure exerted by the conventional locking pawl is therefore insufficient for the positive locking of the slider.

As an additional disadvantage, the elastic deformation of the conventional locking pawl inevitably occurs concentratedly as its end connected to the pull tab. In the use of the lock slider, therefore, the locking pawl is easy to suffer permanent deformation at that end. The amount of this permanent deformation gradually increases until at last the locking pawl becomes incapable of locking the slider.

SUMMARY OF THE INVENTION

It is, therefore, an object of this invention to overcome the above noted problems of the prior art and to provide an improved lock slider which can be positively locked against movement and which will retain this positive locking function for a greatly extended length of time.

With this and other objects in view, the present invention is directed to the provision of a lock slider comprising a body having top and bottom wings or plate members which are connected at their front ends so as to provide the usual guide channel for rows of interlocking fastener elements, and a pull tab connected at one end to the top wing of the slider body for pivotal motion relative to the latter about a predetermined axis. Formed at said one end of the pull tab is a locking pawl which can intrude into the guide channel in the slider body through an aperture formed in its top wing.

The locking pawl has a predetermined point of contact with the fastener elements for pressing same against the bottom wing of the slider body, and hence for locking the slider against movement, when the pull tab is in a recumbent position on the slider body. This contact point of the locking pawl lies forwardly of the axis of the pivotal motion of the pull tab, and rearwardly of the tip of the locking pawl, when the pull tab is in the recumbent position. Also when the pull tab is in the recumbent position, the tip of the locking pawl rests against an abutment on the inside surface of the top wing of the slider body.

Thus, as the locking pawl has its tip placed against the abutment on the inside surface of the slider body top wing when the pull tab is in the recumbent position, a sufficiently high pressure can be thereby exerted on the fastener elements for positively locking the slider. In spite of the repeated use of the lock mechanism over a prolonged period of time, moreover, the locking pawl is not to suffer permanent deformation to such an extent that it becomes thoroughly incapable of locking the slider. Still further, although the locking pawl makes some elastic deformation upon locking of the slider, the pawl can be stably retained in its working position because its point of contact with the fastener elements is disposed forwardly of the axis of the pivotal motion of the pull tab.

The above and other objects, features and advantages of this invention and the manner of attaining them will become more readily apparent, and the invention itself will best be understood, from the following description taken in connection with the accompanying drawings showing a preferred embodiment of the invention.

DESCRIPTION OF THE PREFERRED EMBODIMENT

Figure 1:
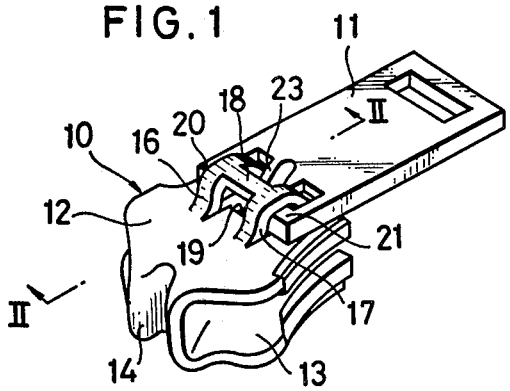
FIG. 1 is a perspective view of a lock slider constructed in accordance with the principles of this invention.

With reference first and in particular to FIG. 1 of the above drawings, a preferred form of a lock slider in accordance with this invention is broadly composed of a body 10 and a pull tab 11, with the latter being pivotally connected to the former. The slider body 10 comprises a pair of flanged top and bottom wings or plate members 12 and 13 which are connected at their front ends, directed toward the left as viewed in FIGS. 1 and 2, by an integral neck 14 so as to provide therebetween the usual Y-shaped guide channel for rows of interlocking fastener elements indicated at 15 in FIG. 2.

The top wing 12 of the slider body 10 has formed thereon a pair of inverted U-shaped lugs 16 and 17 which are spaced from each other in the transverse direction of the slider body and which are integrally connected by a connective portion 18. In this particular embodiment, the lugs 16 and 17 together with the connective portion 18 are formed integral with the slider body top wing 12 by punching and embossing the latter. This construction is by way of example only, however, and is subject to a variety of modifications within the scope of the present invention. The slider body top wing 12 has formed therein an aperture 19 which is located between the pair of lugs 16 and 17 and rearwardly of the neck 14.

Figure 2:
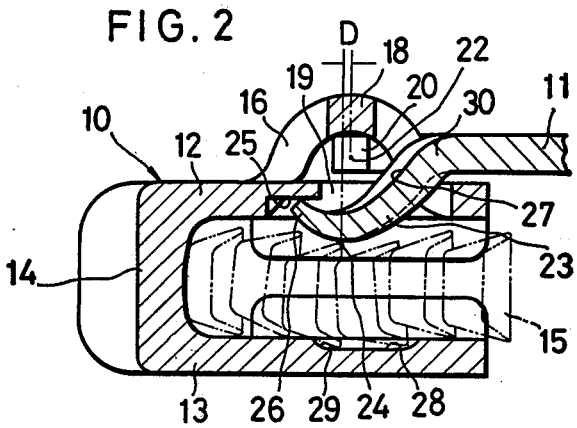
FIG. 2 is an enlarged, cross-sectional view taken along line II—II of FIG. 1.
Figure 3:
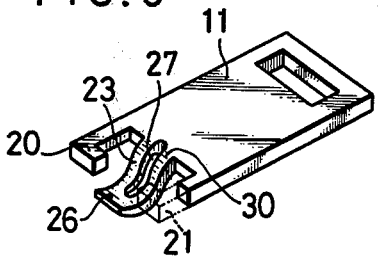
FIG. 3 is a perspective view, partly broken away, of the pull tab of the lock slider of FIGS. 1 and 2.

As best illustrated in FIG. 3, the pull tab 11 has a pair of opposed L-shaped portions 20 and 21 formed at one end thereof. Parts of these L-shaped portions 20 and 21 are somewhat loosely engaged in the respective lugs 16 and 17 on the slider body 10 so as to permit pivotal motion of the pull tab 11 relative to the body about an axis indicated at 22 in FIG. 2.

Also formed at said one end of the pull tab 11 is a locking pawl 23 which is substantially J-shaped as seen in a longitudinal section of the pull tab as in FIG. 2 and which is located between the pair of L-shaped portions 20 and 21. The locking pawl 23 can partly intrude into the guide channel in the slider body 10 through the aperture 19 in its top wing 12.

FIGS. 1 and 2 show the pull tab 11 in a recumbent position on the slider body 10, with the pull tab extending rearwardly of the slider body and lying in a plane substantially parallel to the wings 12 and 13. With the pull tab 11 thus maintained in the recumbent position, its locking pawl 23 projects forwardly and downwardly into the guide channel in the slider body 10, making contact at its predetermined point 24 with the interlocking fastener elements 15 for pressing same against the slider body bottom wing 13. The slider is thus locked against movement in either direction on the rows of fastener elements 15.

It will be noted from FIG. 2 that the predetermined contact point 24 of the locking pawl 23 with the fastener elements 15 is disposed forwardly of the axis 22 of the pivotal motion of the pull tab 11 by a distance D when the pull tab is in the recumbent position on the slider body. It will also be seen that the locking pawl 23 extends forwardly, when the pull tab 11 is in the recumbent position, beyond its contact point 24 with the fastener elements 15.

Seen at 25 in FIG. 2 is an abutment formed on the inside surface of the slider body top wing 12 and disposed just forwardly of the aperture 19 therein. The tip 26 of the curved locking pawl 23 rests against the abutment 25 when the pull tab 11 is in the recumbent position. In the illustrated embodiment, the top wing 12 is reduced in thickness at its portion providing the abutment 25, as by application of pressure or by removal of the material, in order that the pull tab 11 may be smoothly pivoted to and away from the recumbent position in the use of the slider.

It is clear from the foregoing that with the pull tab 11 in the recumbent position, the slider is locked as the locking pawl 23 presses the fastener elements 15 against the slider body bottom wing 13 with its tip 26 resting against the abutment 25 and with the L-shaped pull tab portions 20 and 21 resting against the lugs 16 and 17. Desirably, therefore, some measure should be taken to reduce the possibility of deformation of the locking pawl 23 to a minimum. As an example of such measures, the locking pawl of this particular embodiment has a groove 27 formed as by stamping, the groove 27 extending longitudinally therein and terminating short of the pawl tip 26, so that the locking pawl is mostly formed into the shape of a U in cross section for improved strength.

The bottom wing 13 of the slider body 10 has formed in its inside surface a depression 28 for partly receiving and engaging the fastener elements 15 as they are pressed by the locking pawl 23. This depression 28 is bounded at its front end by a sloping surface 29 such that the particular fastener elements being pressed by the locking pawl 23 will be stably maintained in the correct attitude.

Inevitably, the locking pawl 23 suffers some elastic deformation as same presses the fastener elements 15 against the slider body bottom wing 13 in the above described manner upon pivotal motion of the pull tab 11 to the recumbent position. In spite of the energy thus stored in the locking pawl 23, the pull tab 11 is not to be easily pivoted away from its recumbent position to unlock the slider. This is because the contact point 24 of the locking pawl 23 is disposed forwardly of the axis 22 of the pivotal motion of the pull tab 11 relative to the slider body 10. The lock slider according to this invention can therefore be held locked positively once the pull tab 11 is pivoted to the recumbent position on the slider body 10.

Furthermore, with the pull tab 11 in he recumbent position, the locking pawl 23 is maintained in its working position of FIG. 2 not only by the lugs 16 and 17 but also by the abutment 25 in engagement with the pawl tip 26. The locking pawl 23 is therefore supported at its opposite ends, so to say, so that the locking pawl, while making some elastic deformation as aforesaid, functions to positively press the fastener elements 15 against the slider body bottom wing 13 at its contact point 24. Still further, since such elastic deformation of the locking pawl does not occur concentratedly at its end 30 connected to the pull tab 11, the locking pawl is not to suffer permanent deformation for a markedly extended length of time.

While the improved lock slider according to the present invention has been shown and described in terms of its preferred form, it is to be understood that changes may be made in the construction and arrangements of the various parts of the slider without departing from the spirit or scope of the invention as set forth in the following claims.

What is claimed is:

1. A slider which can be locked against movement in a desired position on rows of interlocking fastener elements, comprising a body having top and bottom wings which are connected at their front ends so as to provide therebetween a Y-shaped guide channel for the fastener elements, there being an aperture in the top wing of the body, a pull tab connected at one end to the top wing of the body for pivotal motion relative to same about a predetermined axis, a locking pawl on said one end of the pull tab intruding into the guide channel in the body through the aperture in its top wing, the locking pawl having a predetermined point of contact with the fastener elements for pressing same against the bottom wing of the body when the pull tab is in a recumbent position on the body, the predetermined contact point of the locking pawl being disposed forwardly of the predetermined axis of the pivotal motion of the pull tab when the latter is in the recumbent position, and an abutment formed on the inside surface of the top wing of the body and disposed forwardly of the aperture therein so as to be abutted upon by a tip of the locking pawl when the pull tab is in the recumbent position, the predetermined contact point of the locking pawl being disposed rearwardly of its tip when the pull tab is in the recumbent position.

2. A slider as recited in claim 1, wherein the bottom wing of the body has a depression formed in its inside surface for partly receiving the fastener elements pressed by the locking pawl.

3. A slider as recited in claim 2, wherein the depression has a sloping surface at its front end.

4. A slider as recited in claim 1, wherein the locking pawl has a groove formed longitudinally therein.

5. A slider as recited in claim 1, wherein the body has lug means formed on its top wing, and wherein the pull tab has at said one end thereof a pair of opposed L-shaped portions which are engaged with the lug means so as to permit the pivotal motion of the pull tab about the predetermined axis, the locking pawl being disposed between the pair of L-shaped portions.

* * * * *